US005292021A

United States Patent [19]

Lyon

[11] Patent Number: 5,292,021

[45] Date of Patent: Mar. 8, 1994

[54] HOLDER FOR LIQUID CONTAINING PACKAGE

[76] Inventor: Christopher J. Lyon, "Quatrocento", 10 Quai des Sanbarbani, Monte Carlo 98000, Monaco

[21] Appl. No.: 671,781

[22] PCT Filed: Apr. 26, 1990

[86] PCT No.: PCT/GB90/00645

§ 371 Date: Mar. 26, 1991

§ 102(e) Date: Mar. 26, 1991

[87] PCT Pub. No.: WO90/13509

PCT Pub. Date: Nov. 15, 1990

[30] Foreign Application Priority Data

Apr. 28, 1989 [GB] United Kingdom ..... 8909845

[51] Int. Cl.[5] ..... B65D 17/44

[52] U.S. Cl. ..... 220/253; 220/717; 220/740; 220/718; 222/83.5; 222/89; 222/548

[58] Field of Search ..... 222/81, 83, 83.5, 85, 222/86, 88-90, 131, 183, 548, 555; 215/11.1, 11.6, 301; 220/411, 717, 718, 740, 771, 253; 229/1.5 H

[56] References Cited

U.S. PATENT DOCUMENTS

| | | | |
|---|---|---|---|
| 1,563,272 | 11/1925 | Fonaas | 222/85 |
| 2,170,282 | 8/1939 | Van Der Spek | 222/835 |
| 2,601,939 | 7/1952 | Grob | 222/86 |
| 2,707,580 | 5/1955 | Harris | 222/83.5 |
| 2,881,952 | 4/1959 | Dungey | 222/89 X |
| 3,266,910 | 8/1966 | Barnby | 222/89 X |
| 4,098,439 | 7/1978 | Blow, Jr. | 222/548 X |
| 4,190,173 | 2/1980 | Mason et al. | 222/548 X |
| 4,561,560 | 12/1985 | Lyon | 220/278 |
| 4,567,995 | 2/1986 | Kreiseder et al. | 222/83 X |
| 4,961,510 | 10/1990 | Dvoracek | 220/717 X |
| 5,150,811 | 9/1992 | Kelston | 220/411 |

FOREIGN PATENT DOCUMENTS

| | | | |
|---|---|---|---|
| 0196198 | 10/1986 | European Pat. Off. . | |
| 0241632 | 10/1987 | European Pat. Off. . | |
| 1211837 | 3/1960 | France | 222/81 |
| 406883 | 8/1966 | Switzerland | 222/83.5 |
| 2046226 | 11/1980 | United Kingdom . | |
| 2135288 | 8/1984 | United Kingdom . | |
| 2170791 | 8/1986 | United Kingdom . | |

OTHER PUBLICATIONS

Das Haus, vol. 119, No. 3, 1971 (DE) "Schaufenster—Die Alete-Lerntasse mit aufschraubbarem Sauger erleichtert dem Baby den Ubergang von der Flasche zur Tasse", p. 119.

*Primary Examiner*—Kevin P. Shaver
*Attorney, Agent, or Firm*—Jones, Tullar & Cooper

[57] ABSTRACT

A hollow container having a top and a bottom and forming an internal cavity which is sized to accommodate an aseptic package, there being an opening in the container providing access to the cavity whereby the aseptic package can be inserted into the cavity and be positioned therein with its top adjacent the top of the cavity. A lid operable to retain the aseptic package within the cavity when closed and puncture projections which depend from the lid and project into the cavity so as to pierce the top of the aseptic package when the latter is positioned therein with its top adjacent the top of the cavity, the puncture projection forming an outlet for liquid to be drunk from within the aseptic package through the top of the container. The upper end of the outlet opens into the interior of a mouthpiece through which liquid is drunk from within the aseptic package within the container when the latter is being used. A rotary shut-off valve, rotatable between an open and a closed position, could also co-operate with the outlet.

14 Claims, 7 Drawing Sheets

HOLDER FOR LIQUID CONTAINING PACKAGE

BACKGROUND OF THE INVENTION

This invention is concerned with aseptic packages which comprises semi-rigid beverage containers which are designed to be sealed after filling and which are provided with an area in their tops which is formed by a preforatable membrane which is to be perforated to enable the beverage to be consumed.

Often such aseptic packages are sold with a drinking straw. The membrane is to be pierced with the straw to open the package. The straw is then immersed in the beverage so that it can be drunk through the straw.

There is a risk of spillage either as the aseptic package is being opened or if it is squeezed once it has been opened. GB-A-2170791 discloses a teat unit having a tubular spike for insertion through the perforatable membrane of an aseptic package which is described as a parallelepipedic box formed from a paper/plastic laminate. The disclosed teat unit provides means for feeding a baby from the aseptic package without the necessity of first dispensing the liquid into a conventional feeding bottle. Such a teat unit suffers from the disadvantage that the liquid contents of the aseptic package spurt out as the spike is being inserted whilst the package is held in the hand. An object of this invention is to There are larger aseptic packages from which the beverage is to be poured into a cup or mug for drinking rather than being drunk directly. U.S. Pat. No. 4,561,560 is concerned with a jug-like container for such an aseptic package, the container having a hinged lid which has depending puncture means associated respectively with a vent hole and an outlet through which liquid can be poured from the container, the outlet and the vent hole being formed in the lid which is arranged so that the puncture means pierce the top of an aseptic package placed within the container as the lid is closed, there being passages in each puncture means leading to the respective aperture whereby liquid contained in the aseptic package can be poured through the outlet via the respective passage in the puncture means. The lid is provided with a sliding closure member which is slidable to open or close the apertures. EP-A-0241632 discloses a similar jug-like container with a pouring spout for an aseptic package. GB-A-2135288 discloses a container which is adapted to enclose a milk or fruit juice carton and which is provided with a pouring spout and means to pierce the top of the carton.

GB-A-2046226 discloses a hollow container of generally rectangular cross-section having a top and a bottom and forming an internal cavity which is sized to accommodate a rectangular sealed package of beverage with semi-rigid walls and a penetrable wall, there being an opening in the container providing access to the cavity whereby the package can be inserted into the cavity and be positioned therein with its top adjacent the top of the cavity, and be removed therefrom, means operable to retain the package within the cavity, and puncture means which depend from the top of the container and project into the cavity so as to pierce the top of the package when the latter is positioned therein with its top adjacent the top of the cavity, the puncture means forming an outlet for liquid from within the package through the top of the container. This disclosure is mainly concerned with drinking the contents of a sealed bag or envelope of plastics material and provides means whereby that can be drunk directly from the bag through a straw or drinking tube which is inserted through the puncture means that are tubular. Such means are not suitable for use by a baby or infant.

SUMMARY OF THE INVENTION

An object of this invention is to cater for the risk of spillage from aseptic packages such as those noted above.

According to this invention there is provided a hollow container generally rectangular cross-section having a top and a bottom and forming an internal cavity which is sized to accommodate a rectangular sealed package of beverage with semi-rigid and a penetrable wall, there being an opening in the container providing access to the cavity whereby the package can be inserted into the cavity and be positioned therein with its top adjacent the top of the cavity, and be removed therefrom, means operable to retain the package within the cavity, and puncture means which depend from the top of the container and project into the cavity so as to pierce the top of the package when the latter is positioned therein with its top adjacent the top of the cavity, the puncture means forming an outlet for liquid within the package through the top of the container, wherein the sealed package is an aseptic package which comprises a semi-rigid beverage container which is designed to be sealed after filling and which is provided with an area in its top which is formed by a perforatable membrane which is to be perforated to enable the beverage to be consumed, and the upper end of the outlet opens into the interior of a mouthpiece which is a separable and replaceable element and which comprises a hollow projecting portion with a perforated outer end, the perforated projecting portion to be placed within the mouth of a user so that liquid is drunk from within the aseptic package within the container when the latter is being used by the user sucking the liquid through the perforated outer end, releasable securing means being provided for fitting the mouthpiece to the top of the container so that there is a seal against leakage of liquid between it and the container, and including a rotary shut-off valve operable to control communication between the interior of an aseptic package retained within the container and the interior of the mouthpiece.

The opening may be at the bottom of the container. Closure means may be provide which are operable to close the opening and retain the aseptic package within the cavity. When such closure means are provided, the opening may be at the top of the container, the closure means comprising a lid which carries the mouthpiece and the puncture means.

The container may be formed of rigid plastics material so that the aseptic package within it cannot be squeezed.

Conveniently the rotary shut-off valve is only accessible for opening and closing when the separable mouthpiece element is not fitted. In another embodiment of the invention, the rotary shut-off valve is operable by rotation of the mouthpiece.

BRIEF DESCRIPTION OF THE DRAWINGS

Several embodiments of the invention will now be described by way of example with reference to the accompanying drawings, of which.

DESCRIPTION OF THE PREFERRED EMBODIMENTS

Figure 1:
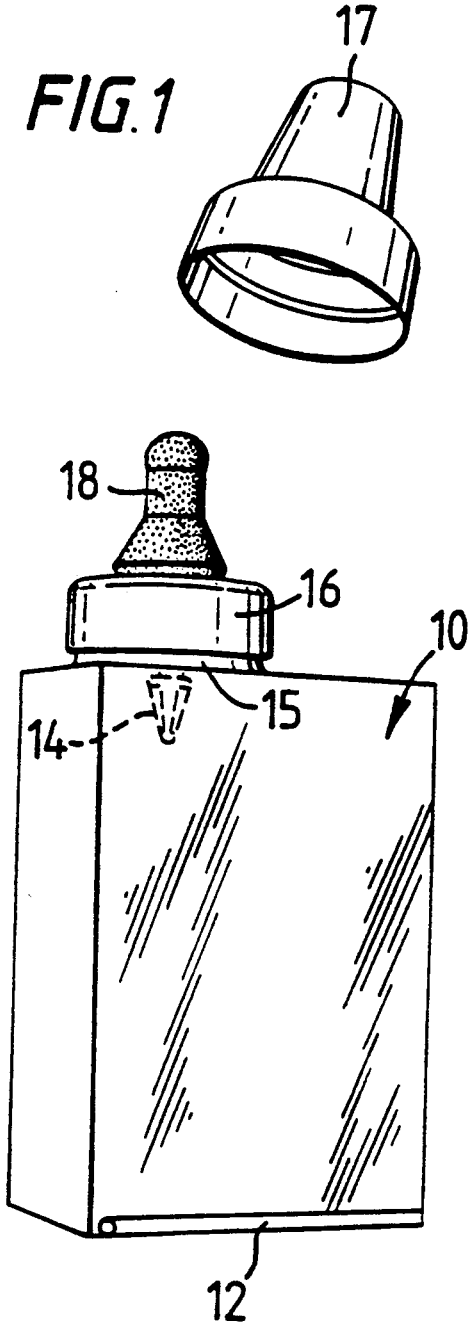
FIG. 1 is a perspective view of a baby's bottle in which this invention is embodied, the teat cover being shown separated.
Figure 2:
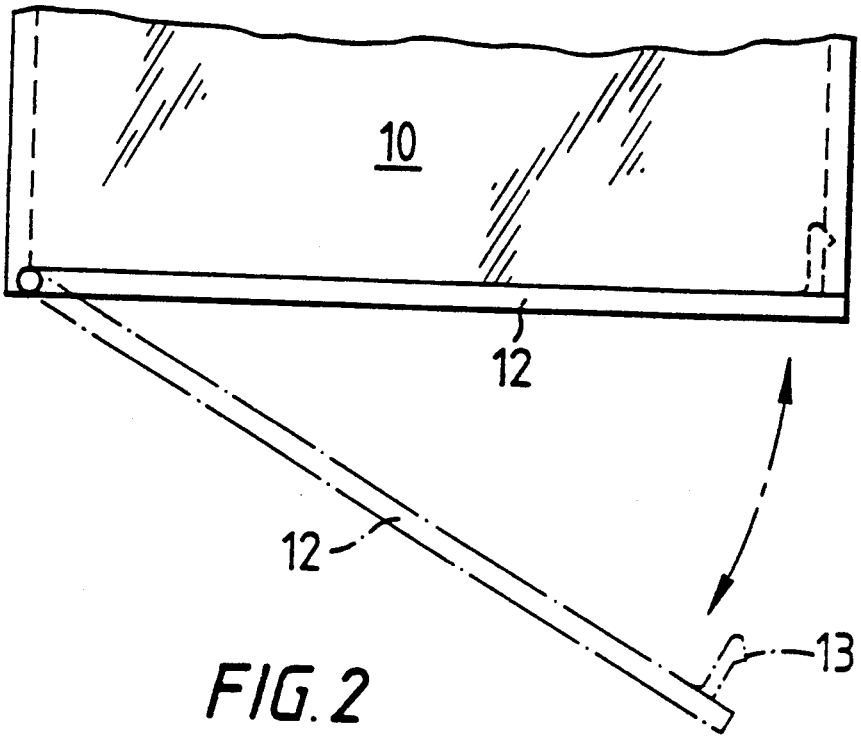
FIG. 2 is a diagram illustrating a bottom closure member for the baby'bottle shown in FIG. 1, the vessel being shown partially broken away for convenience.

FIGS. 1 and 2 show a baby's bottle which is a container comprising a hollow vessel 10 of generally rectangular cross-section which is open at the bottom and which is formed of a rigid plastics material. The vessel 10 comprises a top and four side walls. A closure flap 12 is hinged to the bottom of one of the narrower side walls and is pivotable between the position shown in FIG. 1, and in full lines in FIG. 2, in which it closes the bottom of the vessel 10 and another position in which the bottom of the vessel 10 is open. The flap 12 is shown partially open in dotted lines in FIG. 2.

The vessel 10 is designed to be filled with an aseptic package of the kind having an area in its top formed by a perforatable membrane such as may be perforated by a straw. The aseptic package would be full of a beverage such as fruit juice. The height of the internal cavity of the vessel 10 is such that it just receives the aseptic package when the latter has its top adjacent the top of the vessel 10 and its bottom resting upon the closure flap 12 when that flap 12 is latched in position to close the bottom of the vessel 10 as shown in full lines in FIG. 2. The latch comprises a resilient finger 13 which projects from the inner surface of the flap 12 and which cooperates with a catch formed by an aperture in the narrower side wall of the vessel 10 opposite the narrower side wall to which the flap is hinged. An aperture is formed in the top of the vessel 10 adjacent one of the corners thereof so that the aseptic package can be inserted into the vessel 10 with its perforatable membrane aligned with the aperture which serves as an outlet through which liquid can be sucked form within the aseptic package.

A depending puncture projection 14 is fitted to the underside of the top surface of the vessel 10 around the outlet aperture, depending into the cavity formed by the interior of the vessel 10. The puncture projection 14 tapers to a point at its lower end and has a respective passage formed through it by which the outlet aperture communicates with the interior of the vessel 10. The action of inserting an aseptic package into the interior of the vessel 10 with the perforatable membrane in line with the outlet aperture, and thus with the depending puncture projection 14, causes the puncture projection 14 to pierce the perforatable membrane so that the lower end of the passage through the projection 14 communicates with the interior of the aseptic package.

An up-standing cylindrical boss 15 is mounted on the top surface of the vessel 10 and surrounds the upper end of the outlet aperture. The cylindrical boss receives a conventional teat mounting ring 16 such as is used in conventional baby's bottles. The teat mounting ring 16 secures a teat 18 in position on top of the boss by trapping an integral outwardly directed peripheral flange of the teat 18 between the ring 16 and the rim of the boss. The flange of the teat 18 serves as a seal.

A cup-shaped over 17 is provided for fitting over the teat 18 and the teat mounting ring 16.

In use of the baby's bottle shown in FIG. 1 into which an aseptic package of fruit juice has been inserted so that its perforatable membrane is punctured by the depending puncture projection 14, and to which a teat has been fitted by the teat mounting ring 16, the cover 17 is removed and a baby can suck fruit juice from within the aseptic package through the passage in the depending puncture portion 14 and into the enclosure formed by the well within the cylindrical boss and the teat 18 by the usual action of sucking on the teat 18.

Figure 3:
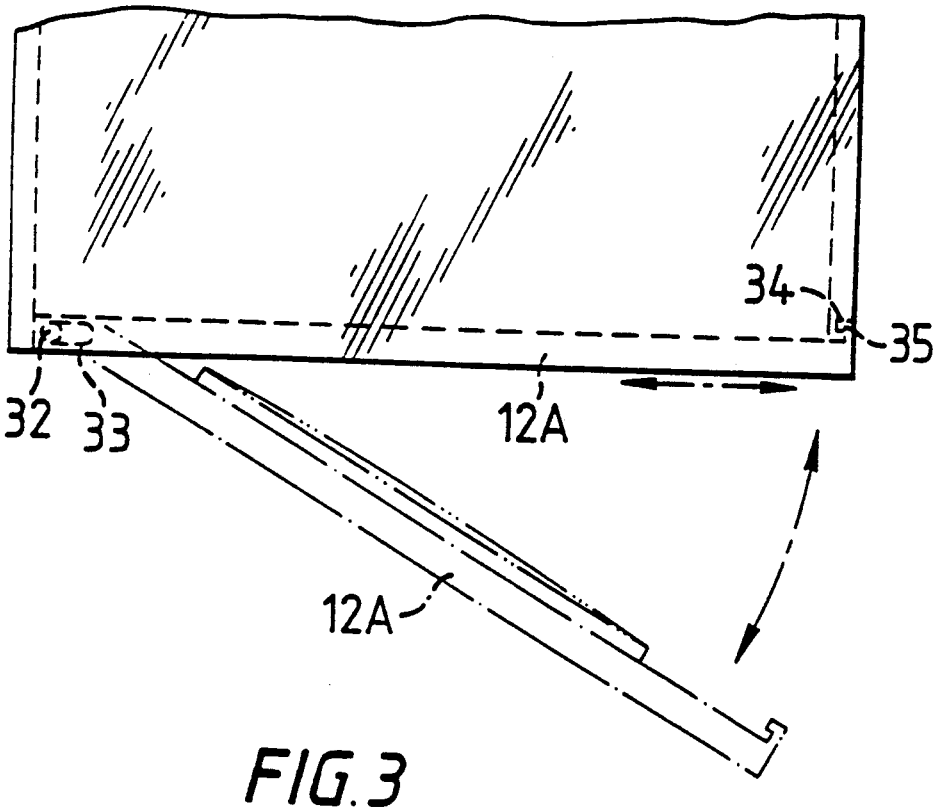
FIG. 3 is a view similar to FIG. 2 showing another form of bottom closure member.

FIG. 3 shows another form of bottom closure member 12A. It is hinged at one end by engagement of a pair of outwardly projections 32 in respective grooves 33 which are formed in the inner surface of each of the longer side walls so that they extend along the bottom of that side wall from one of the narrower side walls towards the other narrower side wall. The latter narrower side wall is cut away at its bottom to provide a recess 34 which is sized to receive the closure member 12A. The latch formed by engagement of the free end of the bottom closure member 12A within the recess 34 comprises an outwardly facing groove in the bottom of the narrower side wall in which the recess 34 is formed, which receives a re-entrant flange 35 formed at the free end of the closure flap 12A and which projects towards the hinge. The flap 12A is opened by sliding it through the recess 34, away from the hinge grooves 33, until the re-entrant flange 35 is moved out of the outwardly-facing groove, whereafter it is pivoted about its projections 32 as is shown in dotted lines in FIG. 3. The reverse movement is used to close and latch the flap 12A in position as shown in full in FIG. 3.

The upper surface of the flap 12A may be concave to provide a profiled base to receive the bottom of the aseptic package.

The hinge grooves may be formed in a separate hinged member which can be hinged downwardly so that the opening formed by opening the closure member 12A is the full width of the container.

Figure 4:
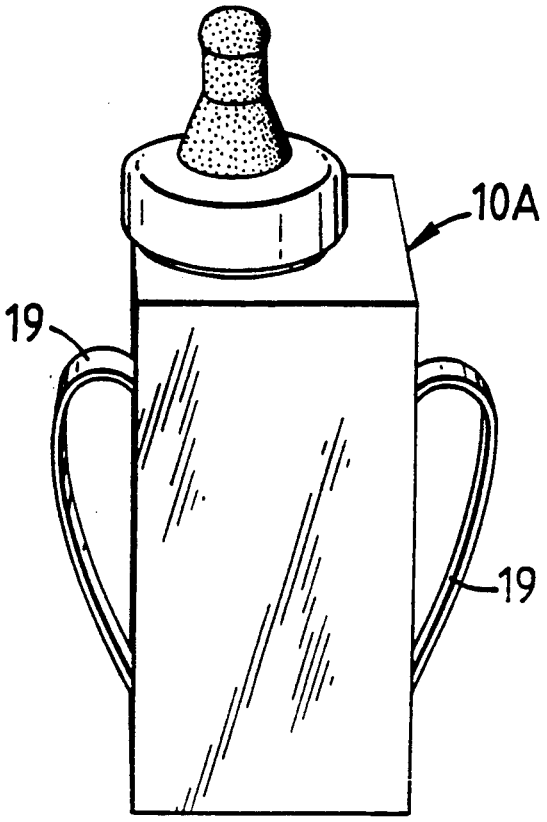
FIG. 4 is an end view of a baby's bottle similar to that shown in FIG. 1 but modified by the provision of a pair of handles.
Figure 5:
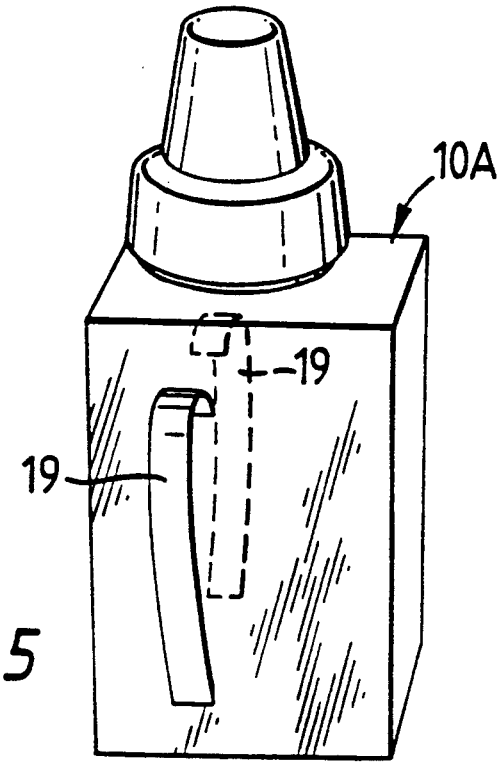
FIG. 5 is a view in perspective of the baby's bottle shown in FIG. 4 with the teat cover fitted.

FIGS. 4 and 5 show a baby's bottle similar to that shown in FIG. 1 in which the wider side walls of the vessel 10A are fitted with a pair of ear-shaped handles 19 by which the baby can hold the bottle with both hands. The ends of each handle 19 may have a slider base portion which is slidably retained in a respective retaining groove formed in the respective side wall of the vessel 10A, each groove having a trapezoidal cross-section, the base of the groove being wider than the mouth and the side walls tapering towards the mouth through which the handle 19 projects. Conveniently each groove extends to at least the top or the bottom of the respective side wall.

Figure 6:
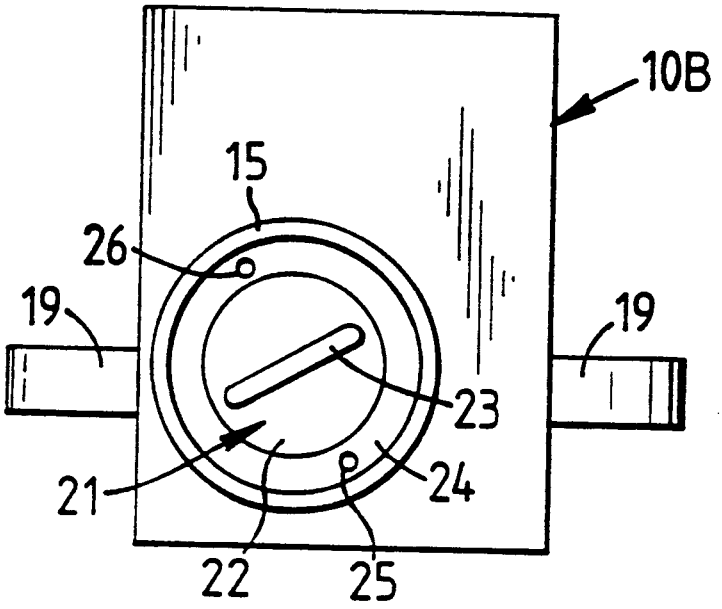
FIG. 6 is a partial top view of a baby's bottle similar to that shown in FIGS. 4 and 5 with the teat removed to expose a rotary shut-off valve.

The baby's bottle shown in any one of FIGS. 1 to 5, is provided with a rotary shut-off valve 21 at the base of the cylindrical boss 15 as shown in FIG. 6. The valve 21 comprises a rotor 22 with an up-standing projection 23 which is to be gripped between a thumb and a first finger for rotation. The annular radially-outer portion of the rotor 22 extends between the top of the vessel 10B, including that part of it which defines the upper end of the outlet aperture, and a radially-inwardly directed annular flange 24 which is formed integrally with the internal surface of the cylindrical boss 15. A circumferentially continuous ring of elastomeric material is bonded to the annular radially-outer portion of the rotor 22 so as to be slightly compressed and to be in rubbing contact with the underside of the flange 24. An aperture 25 is formed in the flange 24 in line with the outlet aperture. A second aperture 26 is formed in the flange 24 diametrically opposite the aperture 25 and that second aperture 26 is in line with a second or vent aperture which is formed in the top of the vessel 10B at the upper end of a second puncture projection which has a through passage for venting the aseptic package. A diametrically-opposed pair of apertures formed in the rotor 22 and the ring of elastomeric material can be brought by rotation of the rotor 22 into line with the respective ones of the outlet aperture and the vent aperture and the aligned apertures 25 and 26 in the radially-inwardly directed flange 24 to open communication between the interior of the aseptic package via the passages through the depending puncture portions and the enclosure comprising the well formed by the cylindrical boss 15, the teat mounting ring 16 and the teat 18.

The baby's bottle shown in any one of the FIGS. 1 to 6 may be modified by being formed with a fixed base and a hinged lid at the top which carries the cylindrical boss 15 and the depending puncture projection 14. In use of such a modification, the lid would be opened, the aseptic package would be inserted into the vessel and placed on the closed bottom whereafter the lid would be closed, the perforatable membrane of the aseptic package being pierced by the depending puncture portion 14 in the action of closing the lid.

Figure 7:
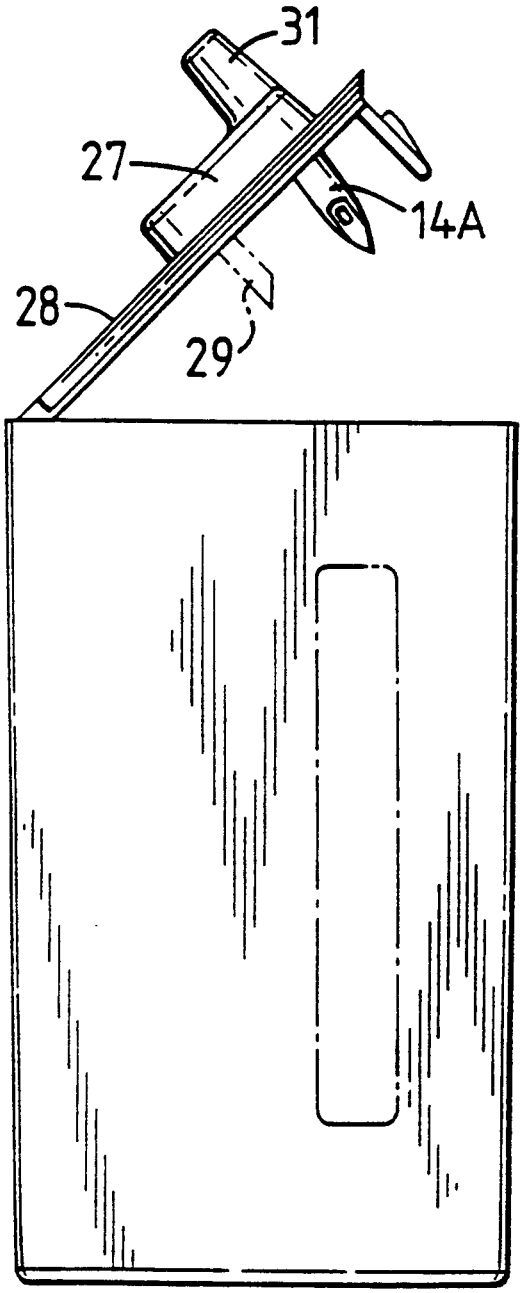
FIG. 7 is a side view of another form of drinking bottle in which this invention is embodied.

FIG. 7 shows a drinking bottle wherein the cylindrical boss 15 and teat mounting ring 16 of the baby's bottles shown in FIGS. 1 to 6 are replaced by a moulded drinking mouthpiece 27 which is mounted on the top surface of a hinged lid 28, there being two depending puncture portions 14A and 29, one, 14A being for puncturing the perforatable membrane of the aseptic package inserted into the vessel 10C and the second 29 being spaced therefrom to serve as a vent. The mouthpiece 27 is hollow. The apertures in the lid 28 at the upper ends of the puncture projections 14A and 29 communicate with the interior of the mouthpiece 27 which has a projecting spout portion 31 with a perforated outer end. The user would place the spout portion 31 in his mouth and suck through the perforations to draw drink from the interior of the aseptic package through the depending puncture portion 14A and the interior of the mouthpiece 27.

As with the baby's bottle described above with reference to FIGS. 1 to 5, it may not be necessary to provide the second or vent aperture and its associated second puncture projection 29, the primary puncture projection 14A and its associated aperture being sufficient for drinking from either of the containers shown in FIGS. 6 to 9. Also handles (shown chain dotted) may be provided.

Figure 8:
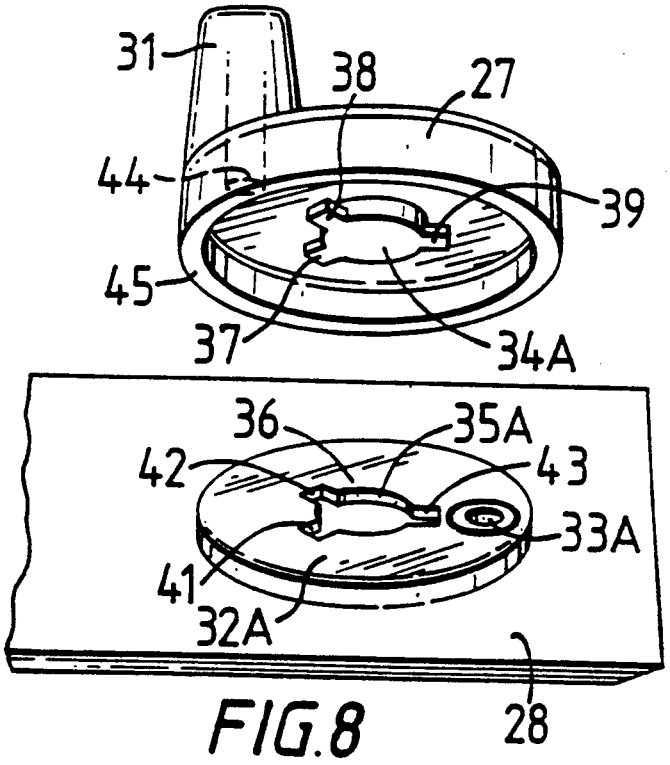
FIG. 8 is an exploded view in perspective of a fragment of a drinking bottle similar to that shown in FIG. 7 comprising the mouthpiece and a rotary shut-off valve.

The mouthpiece 27 of the drinking bottle shown in FIG. 7 may be mounted on the top of the vessel so as to be rotatable relative thereto and a rotary shut-off valve is provided for controlling communication between the interior of the aseptic package and the interior of the mouthpiece, the rotary shut-off valve being operable to open or close that communication by rotation of the mouthpiece relative to the vessel. FIG. 8 shows such an arrangement in which the mouthpiece 27 is separable from the vessel being mounted thereon by a bayonet-type fitting which comprises a plate 32A which is secured to the top of the vessel and which is formed with an aperture 33A in alignment with each aperture in the top of the vessel, and a central projection 34A from the bottom of the mouthpiece 27. The plate 32A has a central hole 35A formed in it, the lower portion of the central hole 35A being rebated to leave an inwardly-directed flange 36. The central projection 34A has three circumferentially-spaced tabs 37–39 projecting radially outwardly from its outer end, the spacing between a juxtaposed pair 37 and 38 of those tabs 37–39 being smaller than the spacing between each tab 37, 38 of that pair and the third tab 39. Three slots 41–43 are formed in the inwardly-directed flange 36 of the plate 32A and they are sized and located so that the central projection 34A of the mouthpiece 27 can be inserted into the central hole 35A of the plate 32A, with a respective one of the tabs 37–39 passing through a respective one of the slots 41–43. Once so inserted, the mouthpiece 27 is secured to the vessel by being rotated through 180° to position the tabs 41–43 under the inwardly-directed flange 36. The mouthpiece 27 would also have an aperture 44 for each aperture in the plate 32A in its surface 45 which seats on the plate, the arrangement being such that communication between the interior of the aseptic package and the interior of the mouthpiece 27 is established when the respective apertures 33A and 44 in the plate 32A and the mouthpiece 27 are in alignment and is cut off by rotary displacement through 90° of the mouthpiece 27 from that position.

Figure 9:
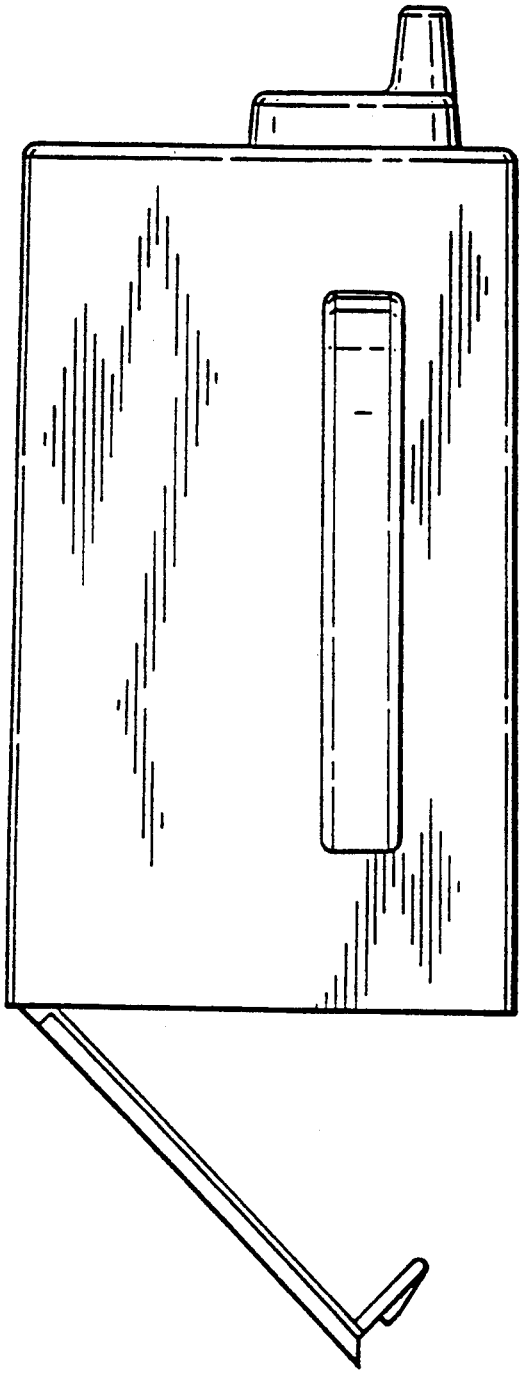
FIG. 9 is a side view of a modified form of the drinking bottle shown in FIGS. 7 and 8.

As with the baby's bottle described above, the top of the vessel on which the mouthpiece 27 and any rotary shut-off valve are mounted may be formed integrally with the sidewalls of the vessel which forms an opening for insertion of an aseptic package at its bottom. FIG. 9 shows such an arrangement which includes a closure flap similar to the flap 12 shown in FIGS. 1 and 2.

The closure member, be it a top lid 28 or a bottom closure flap 12 may be provided with a peripherally continuous sealing element of elastomeric material to engage with the structure of the side walls and provide for sealing against egress of liquid from within the container. The sealing element may be mounted in an annular groove in the inner planar surface of the closure member for face to face sealing contact with the ends of the side wall structure. Alternatively the sealing element may be mounted in a groove formed in the peripheral edge of the closure member so that it projects outwardly from that edge into sealing engagement with the inner surfaces of the side walls.

Where the problem of squeezing a semi-rigid aseptic package is unimportant, a less rigid plastics material such as polypropylene could be used. In that case the closure member, be it a lid or a bottom flap could be moulded integrally with the remainder of the container, being connected to the appropriate side wall by a thinner portion which comprises a live hinge. As an alternative to a latch arrangement, the lid could be provided with a circumferential lip which fits over the end portions of the side walls which it surrounds.

Although not illustrated in the drawings, it should be understood that each puncture projection 14, 14A or 29 of a container in which this invention is embodied is preferably provided with a generally frusto-conical seal ring of the kind which comprises an array of axially-spaced radially-outwardly projecting ribs. The seal rings are so located that they seat upon the top of the aseptic package, around the respective puncture, when the container is closed and thereby serve to seal against seepage of beverage from within the aseptic package passed the respective puncture projection 14, 14A and 29.

Figure 10:
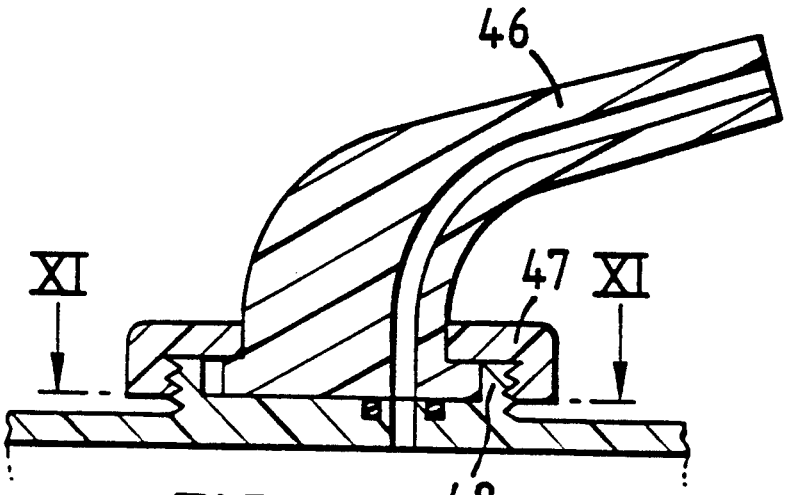
FIG. 10 is a transverse section through a rotary spout for a container in which this invention is embodied.
Figure 11:
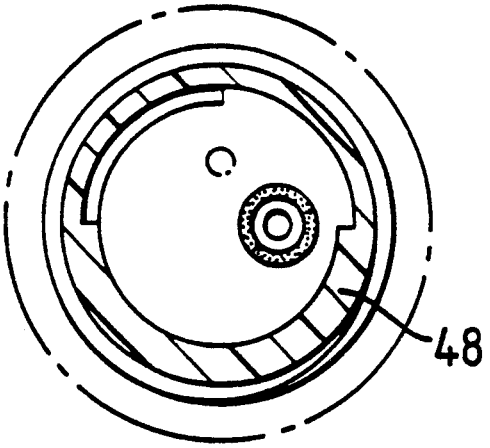
FIG. 11 is a section on the line XI—XI of FIG. 10.

FIGS. 10 and 11 show the container may be fitted with a rotatable spout 46 which has a mounting ring 47 similar to the teat mounting ring 16 and which is engageable in a similar manner on a similar cylindrical boss 48, the spout 46 being integral with the upper surface of the mounting ring 47. The rotatable spout 46 may incorporate a shut-off valve which is operable in a manner similar to that of the rotary shut-off valve described above with reference to FIGS. 6 and 8, but by rotation of the spout. The spout may be used as a mouthpiece for drinking or as a pouring device for a liquid such as cream.

I claim:

1. A hollow container of generally rectangular cross-section having a top and a bottom and forming an internal cavity which is sized to accommodate a rectangular sealed package of beverage with semi-rigid walls and a penetrable wall, there being an opening in the container providing access to the cavity whereby the package can be inserted into the cavity and be positioned therein with its top adjacent the top of the cavity, and be removed therefrom, wherein the sealed package is an aseptic package which comprises a semi-rigid beverage container which is designed to be sealed after filling and which is provided with an area in its top which is formed by a perforatable membrane which is to be perforated to enable the beverage to be consumed, and the upper end of the outlet opens into the interior of the mouthpiece, comprising: means operable to retain the package within the cavity; puncture means which depend from the top of the container and project into the cavity so as to pierce the top of the package when the latter is positioned therein with its top adjacent the top of the cavity, said puncture means forming an outlet for liquid from within the package through the top of the container, a mouth piece which is a separable and replaceable element and which comprises a hollow projecting portion with a perforated outer end, the perforated projecting portion to be placed within the mouth of a user so that liquid is drunk from within the aseptic package within the container when the latter is being used by the user sucking the liquid through the perforated outer end; releasable securing means being provided for fitting the mouthpiece to the top of the container so that there is a seal against leakage of liquid between it and the container; and a rotary shut-off valve operable to control communication between the interior of the aseptic package retained within the container and the interior of the mouthpiece.

2. The hollow container according to claim 1, further wherein the opening is at the bottom of the container.

3. The hollow container according to claim 1, further wherein the opening is at the top of the container and said means operable to close the opening and retain the aseptic package within the cavity comprises a lid which carries the mouth-piece and the puncture means.

4. The hollow container according to claim 1, 2 or 3, further wherein said means operable to retain the aseptic package within the cavity comprises closure means operable to close the opening.

5. The hollow container according to claims 1, 2 or 3, further wherein the container is formed of rigid plastics material so that the aseptic package within it cannot be squeezed.

6. The hollow container according to claims 1, 2 or 3, further wherein the rotary shut-off valve is only accessible for opening and closing when the separable mouthpiece element is not fitted.

7. The hollow container according to claims 1, 2 or 3, further wherein the rotary shut-off valve is operable by rotation of the mouthpiece.

8. The hollow container according to claims 1, 2 or 3, further comprising an upstanding boss on the top surface of the container, and further wherein the rotary shut-off valve is provided within the upstanding boss, the boss surrounding the upper end of said outlet and encompassing an area which is smaller than the area of that top surface.

9. The hollow container according to claim 8, further wherein the boss is offset from the middle of the top surface.

10. The hollow container according to claim 8, further wherein the replaceable mouthpiece is fitted to the boss at its upper end and secured thereto by said releasable securing means which are received by said boss.

11. The hollow container according to claims 1, 2 or 3, further wherein each of the wider side walls of the container is fitted with a respective one of a pair of handles by which the container can be held with both hands.

12. The hollow container according to claims 1, 2 or 3, further wherein said puncture means are provided with a seal ring located to seat upon the top of the aseptic package around the puncture that is formed by piercing the top of the aseptic package when the latter is positioned therein, thereby to seal against seepage of beverage from within the aseptic package around the puncture projection.

13. The hollow container according to claims 1, 2 or 3, further wherein said means operable to retain the aseptic package within the cavity comprise a closure flap which is hinged at one end to one of the narrower side walls and which has a latch at its other end, the latch comprising a resilient finger which cooperates with a catch formed by an aperture in the other narrower side wall.

14. The hollow container according to claim 9, further wherein the replaceable mouthpiece if fitted to the boss at its upper end and secured thereto by said releasable securing means which are received by said boss.

* * * * *